US005536072A

United States Patent [19]

Chang

[11] Patent Number: 5,536,072

[45] Date of Patent: Jul. 16, 1996

[54] ELEVATION-ADJUSTABLE STAND

[76] Inventor: John Chang, No. 1-2, Lane 975, Chun-Jih Road, Tao-Yuan City, Taiwan

[21] Appl. No.: 508,534

[22] Filed: Jul. 28, 1995

[51] Int. Cl.[6] ..... A47C 7/50

[52] U.S. Cl. ..... 297/423.45; 482/52; 248/422

[58] Field of Search ..... 297/423.45, 423.46, 297/344.12, 344.15; 482/52; 248/188.2, 669, 422; 108/11, 106, 144, 147

[56] References Cited

U.S. PATENT DOCUMENTS

| | | | |
|---|---|---|---|
| 789,813 | 5/1905 | Longley | 297/423.45 X |
| 4,228,745 | 10/1980 | Gale | 297/423.45 X |
| 5,169,360 | 12/1992 | Saunders | 482/52 |
| 5,294,180 | 3/1994 | Grimm | 297/423.44 |

FOREIGN PATENT DOCUMENTS

| | | | |
|---|---|---|---|
| 1079004 | 8/1967 | United Kingdom | 297/423.45 |

*Primary Examiner*—Peter R. Brown

*Attorney, Agent, or Firm*—Morton J. Rosenberg; David I. Klein

[57] ABSTRACT

An elevation-adjustable stand including a top block covered with a soft mat, a toothed shaft revolvably mounted on downward lugs of the top block, two end caps fastened to two opposite ends of the toothed shaft, two base blocks turned about the end caps for supporting the top block on the ground, two stop members coupled between the toothed shaft and the base blocks, and an adjustment knob fixed to one end of the toothed shaft for turning it to move the stop members in reversed directions in changing the elevation of the top block.

1 Claim, 9 Drawing Sheets

ELEVATION-ADJUSTABLE STAND

BACKGROUND OF THE INVENTION

The present invention relates to an elevation-adjustable stand for use in acrobatic exercises or as a pillow or seat which can be adjusted to different heights to meet different requirements.

In an aerobatic exercise, a foot stand is commonly used. FIGS. 1 and 2 show a foot stand for this purpose. As illustrated, the foot stand 1 comprises a base block 11 having two upright ratchets 111 at two opposite sides, a top shell 12 covered on the base block 11 and having two pawl members 121 bilaterally disposed on the inside and respectively meshed with the upright ratchets 111. The elevation of the top shell 12 can be adjusted relative to the base block 11. However, the procedure of adjusting the elevation of the top shell 12 relative to the base block 11 is not easy and must be done by both hands. When to adjust the elevation of the top shell 12, the pawl members 121 of the top shell 12 must be disengaged from the upright ratchets 111 by both hands, and then the top shell 12 is lifted to the desired elevation. When the pawl members 121 are released from the hands, they immediately return to their former shape and engage with the upright ratchets 111 again, and therefore the top shell 12 is stopped at the desired elevation. However, because the pawl members 121 and the ratchets 111 are not visible during the adjusting procedure, the adjustment can only be checked by the sense of touch, therefore several trials may be needed to achieve the desired adjustment.

SUMMARY OF THE INVENTION

The present invention has been accomplished to provide an elevation-adjustable stand which eliminates the aforesaid drawbacks. It is therefore one object of the present invention to provide an elevation-adjustable stand which can be conveniently adjusted to different heights to meet different requirements. It is another object of the present invention to provide an elevation-adjustable stand which can be adjusted to different heights by one hand. It is still another object of the present invention to provide an elevation-adjustable stand which can be used as a foot stand for aerobatic exercises, a pillow for putting under the head, or a seat for sitting. According to the preferred embodiment of the present invention, the elevation-adjustable stand comprises a top block covered with a soft mat, a toothed shaft revolvably mounted on downward lugs of the top block, two end caps fastened to two opposite ends of the toothed shaft, two base blocks turned about the end caps for supporting the top block on the ground, two stop members coupled between the toothed shaft and the base blocks, and an adjustment knob fixed to one end of the toothed shaft for turning it to move the stop members in reversed directions in changing the elevation of the top block.

DETAILED DESCRIPTION OF THE PREFERRED EMBODIMENT

Figure 1:
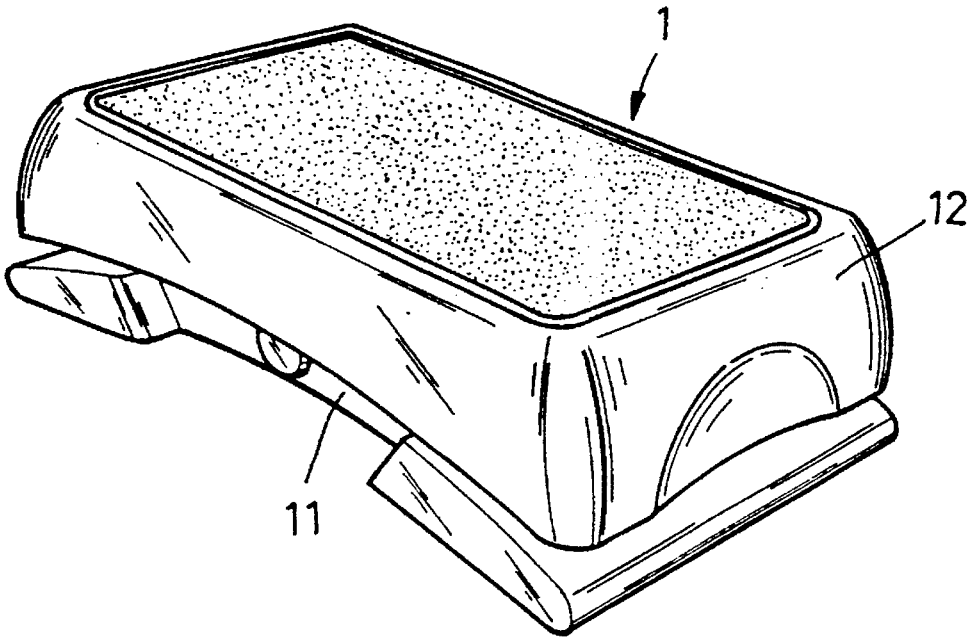
PRIOR ART FIG. 1
FIG. 1 is an elevational view of a stand for aerobatic exercise according to the prior art.
Figure 2:
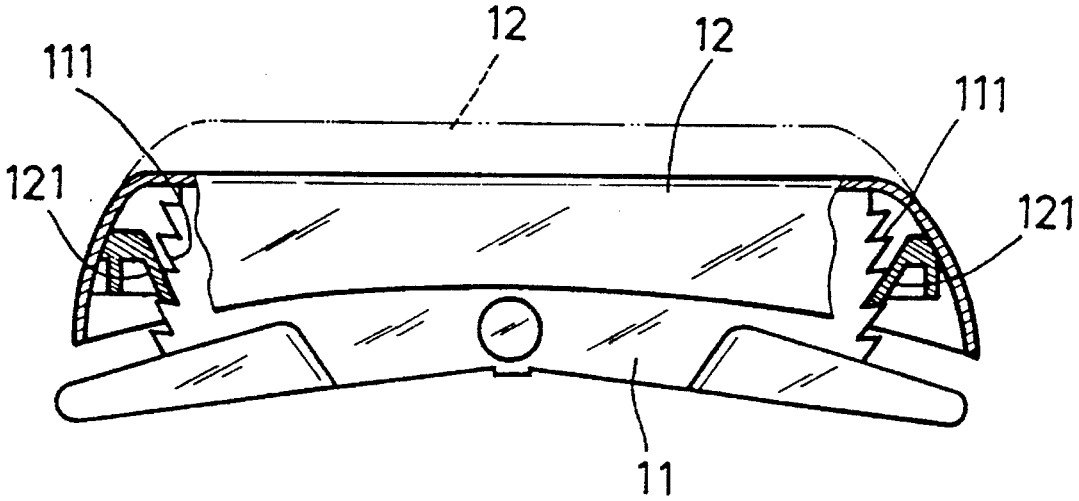
PRIOR ART FIG. 2
FIG. 2 is a side view in section of the stand shown in FIG. 1.
Figure 3:
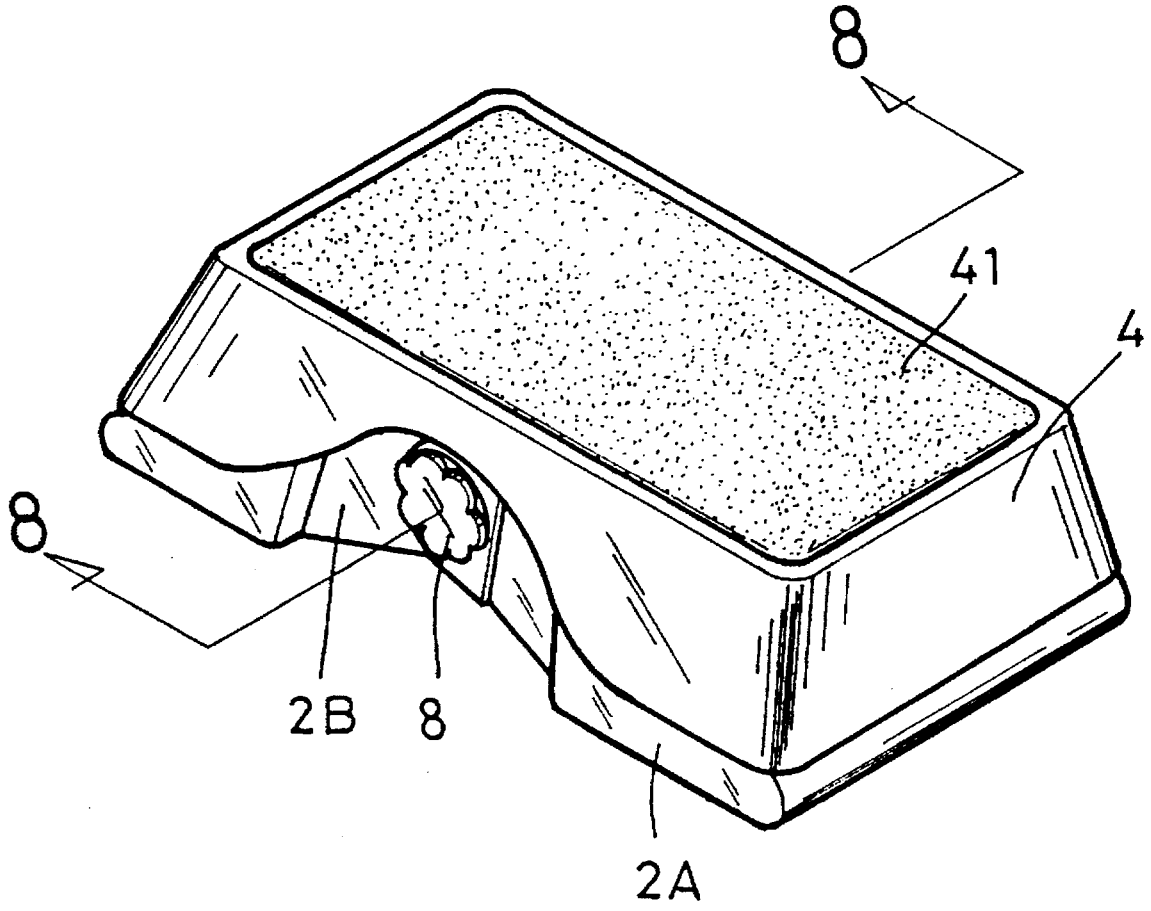
FIG. 3 is an elevational view of an elevation-adjustable stand according to the present invention.
Figure 4:
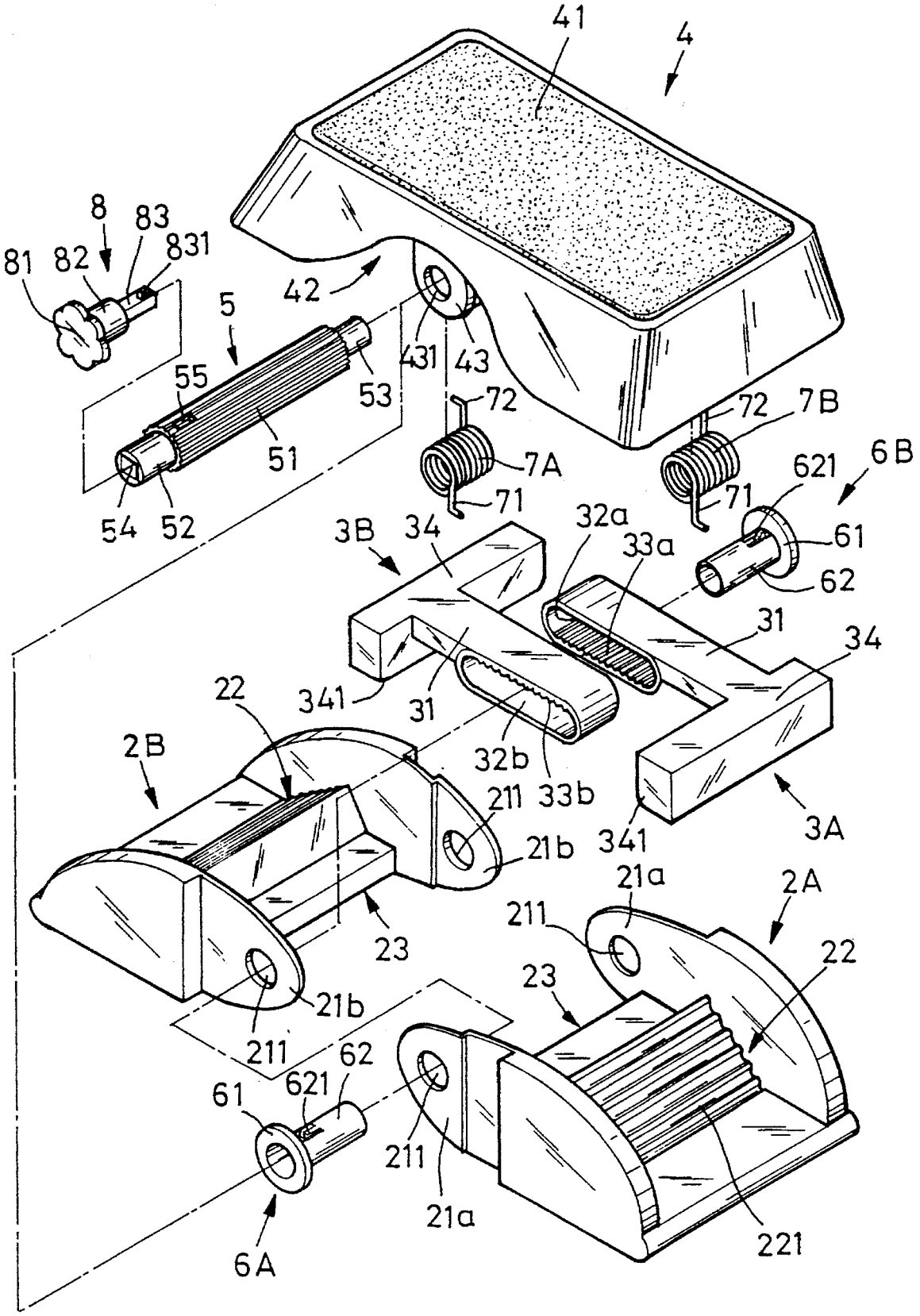
FIG. 4 is an exploded view of the elevation-adjustable stand shown in FIG. 3.

Referring to Figures from 3 to 8, an elevation-adjustable stand in accordance with the present invention is generally comprised of two symmetrical base blocks 2A and 2B, two symmetrical stop members, namely, the first stop member 3A and the second stop member 3B, a top block 42, a shaft 5, two end caps 6A and 6B, two torsional springs 7A and 7B, and an adjustment knob 8. The base block 2A or 2B comprises two forward lugs 21*a* or 21*b* bilaterally extended from the front side, each lug 21*a* or 21*b* having a respective pivot hole 211, an upstanding sloping wall 22 in the middle, and a series of transverse grooves 221 on the upstanding sloping wall 22 at different elevations. The stop members 3A or 3B are respectively mounted above the base blocks 2A and 2B, each comprising a longitudinal coupling rod 31, a transverse stop rod 34 perpendicularly connected to the longitudinal coupling rod 31 at one end. The longitudinal coupling rod 31 defines a longitudinal opening 32*a* or 32*b*. The first stop member 3A further comprises a rack 33*a* inside the longitudinal opening 32*a* at the bottom. The second stop member 3B further comprises a rack 33*b* inside the longitudinal opening 32*b* at the top. The transverse stop rod 34 of each stop member 3A or 3B has a chamfered bottom side 341 for engagement with one transverse groove 221 of the upstanding sloping wall 22 of one base block 2A or 2B. The top block 4 comprises a flat top side covered with a soft mat 41, two curved side walls 42 at two opposite sides, two opposite pairs of downward lugs 43 bilaterally disposed in the middle, each lug 43 defining a respective pivot hole 431, and a bottom chamber 44 defined between the two opposite pairs of downward lugs 43 for holding the stop members 3A and 3B. The shaft 5 comprises a toothed shaft body 51 inserted through the longitudinal openings 32*a* and 32*b* and meshed with the racks 33*a* and 33*b*, two round rods 52 and 53 respectively extended from two opposite ends of the toothed shaft body 51 and inserted into the pivot holes 431 of the downward lugs 43 of the top block 4, a rectangular coupling hole 54 on one round rod 52, and a longitudinal slot 55 on the toothed shaft body 51 in communication with the rectangular coupling hole 54. The end caps 6A and 6B are respectively inserted through the pivot holes 211 of the lugs 21*a* and 21*b* of the base blocks 2A and 2B and then sleeved onto the round rods 52 and 53 of the shaft 5, each comprising a barrel 62 inserted into the respective pivot holes 211 of the base blocks 2A and 2B at one side and sleeved onto one round rod 52 or 53 of the shaft 5, an outward flange 61 raised around one end of the barrel 62 and stopped outside the base blocks 2A and 2B, and a springy hook 621 raised from the barrel 62 and hooked on one lug 43 of the top block 4. The torsional springs 7A and 7B are respectively mounted around the barrels 62 of the end caps 6A and 6B, each having two opposite ends 71 and 72 respectively stopped at the front edges 23 of the base blocks 2A and 2B. The adjustment knob 8 comprises a round shank 82 inserted into the barrel 62 of one end cap 6A, a square extension rod 83 longitudinally extended from one end of the round shank 82 and fitted into the rectangular coupling hole 54 of the round rod 52 of the shaft 5, a springy hook 831 raised from the square extension rod 83 and hooked into the longitudinal slot 55 on the toothed shaft body 51 of the shaft 5, and a hand wheel 81 at an opposite end of the round shank 82 for turning by hand. When the adjustment knob 8 is turned to rotate the shaft 5, the stop members 3A and 3B are synchronously moved in reversed directions, and therefore the elevation of the stand is adjusted.

Figure 8:
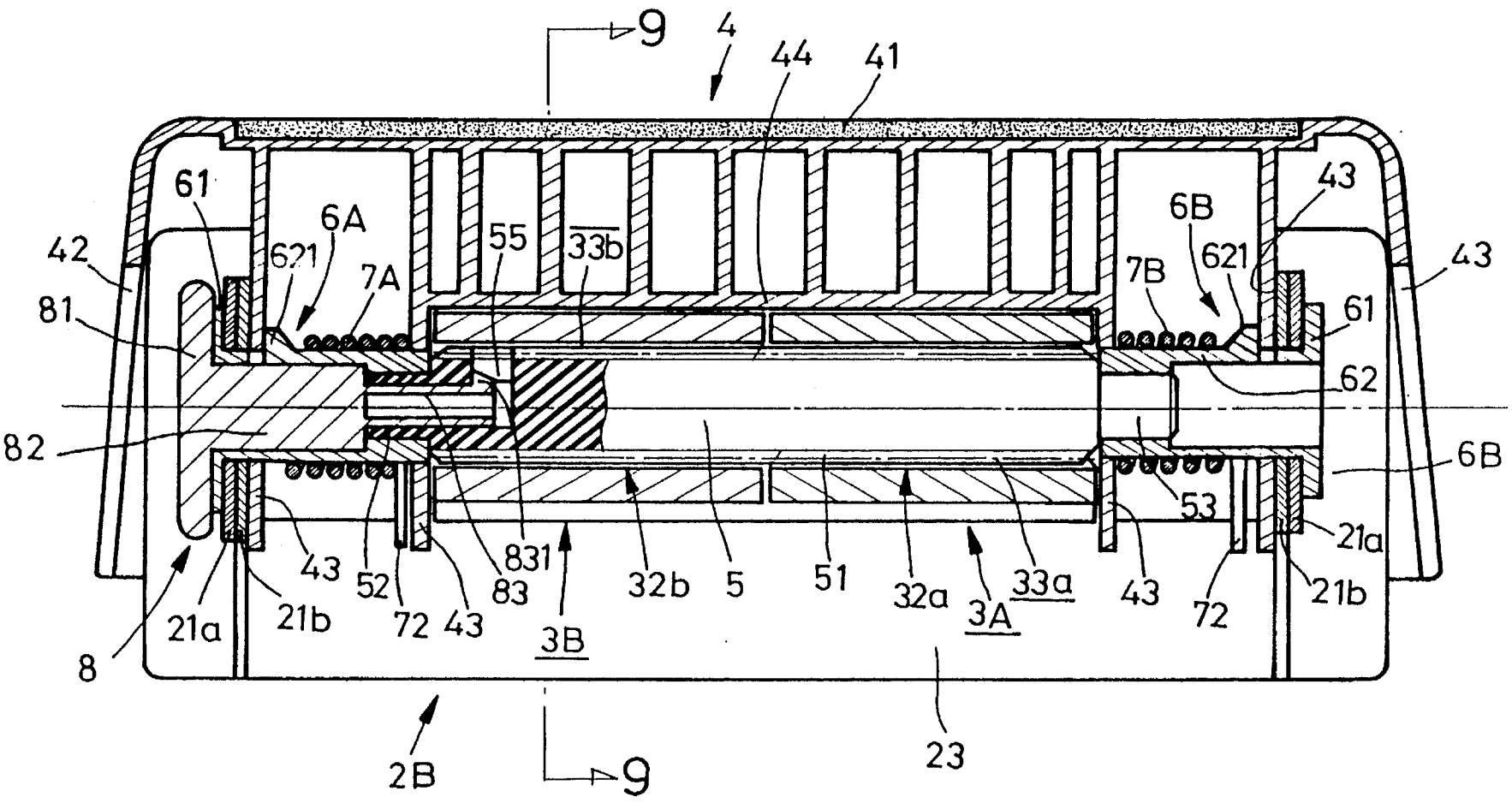
FIG. 8 is a side view in section of the elevation-adjustable stand shown in FIG. 3.
Figure 9:
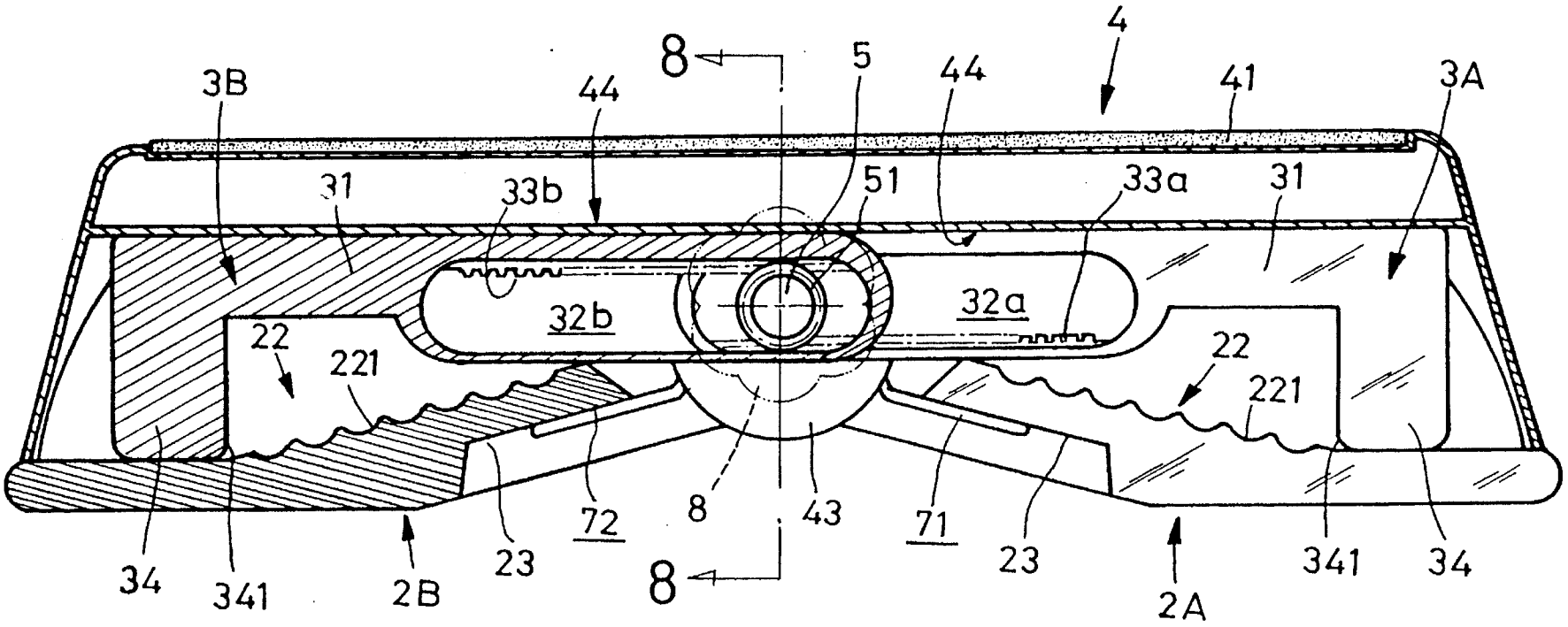
FIG. 9 is a sectional view taken along line 9—9 of FIG. 8.

Referring to FIG. 9 and FIG. 8 again, the toothed shaft body 51 of the shaft 5 are inserted into the longitudinal openings 32*a* and 32*b* of the stop members 3A and 3B and meshed with the racks 33*a* and 33*b*; the round rods 52 and 53 of the shaft 5 are respectively inserted into the barrels 62 of the end caps 6A and 6B and supported on the lugs 43 of the top block 4; the end caps 6A and 6B are inserted into the pivot holes 431 of the respective lugs 43 of the top block 4 with the respective springy hooks 621 respectively hooked on the respective lugs 43. Therefore, the shaft 5 is revolvably supported between the end caps 6A and 6B, and rotating the shaft 5 causes the stop members 3A and 3B moved in the bottom chamber 44 of the top block 4 in reversed directions. The lugs 21*a* and 21*b* of the base blocks 2A and 2B are respectively attached together, then attached to the lugs 43 of the top block 4 at two opposite sides, and then pivotably connected to the lugs 43 of the top block 4 by the end caps 6A and 6B. Therefore, the base blocks 2A and 2B are pivoted to the end caps 6A and 6B and supported on the ground. Because the torsional springs 7A and 7B are respectively mounted around the barrels 62 of the end caps 6A and 6B and stopped between the front edges 23 of the base blocks 2A and 2B, the base blocks 2A and 2B are respectively stretched outwards. Therefore, the base blocks 2A and 2B do not drop when the stand is lifted from the ground.

Figure 5:
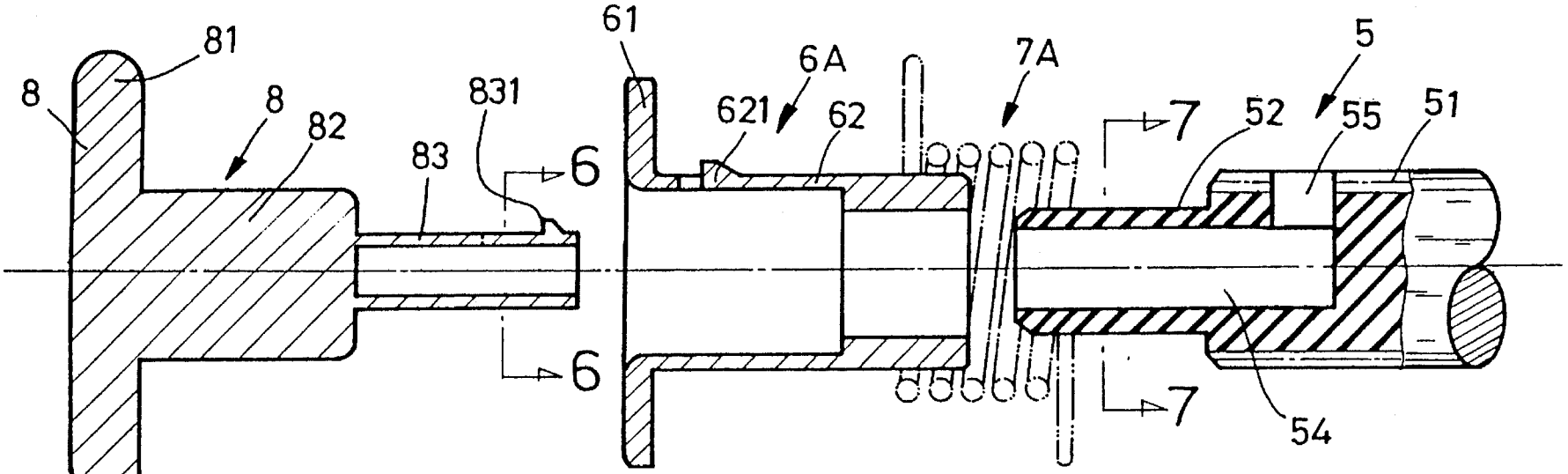
FIG. 5 an exploded view in section showing the relative positions of the adjustment knob, the end cap, the torsional spring, and the shaft according to the present invention.
Figure 7:
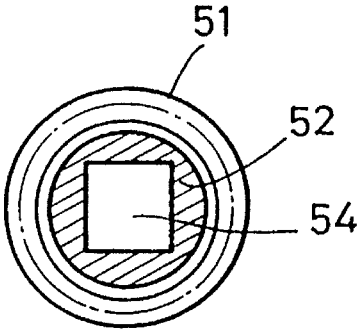
FIG. 7 is a sectional view taken along line 7—7 of FIG. 5.
Figure 6:
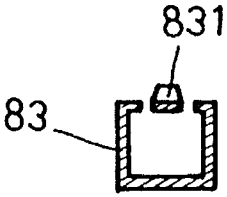
FIG. 6 is a sectional view taken along line 6—6 of FIG. 5.

Referring to FIG. 5 again, the square extension rod 83 and round shank 82 of the adjustment knob 8 are respectively inserted into rectangular coupling hole 54 of the shaft 5 and the barrel 62 of one end cap 6A, and the springy hook 831 of the adjustment knob 8 is hooked in the longitudinal slot 55 of the shaft 5, therefore when the adjustment knob 8 is rotated, the shaft 5 is turned about the longitudinal central axis of the end caps 6A and 6B by the square extension rod 83 of the adjustment knob 8. Because the springy hook 831 is hooked in the longitudinal slot 55, the adjustment knob 8 does not disconnect from the shaft 5.

Figure 10:
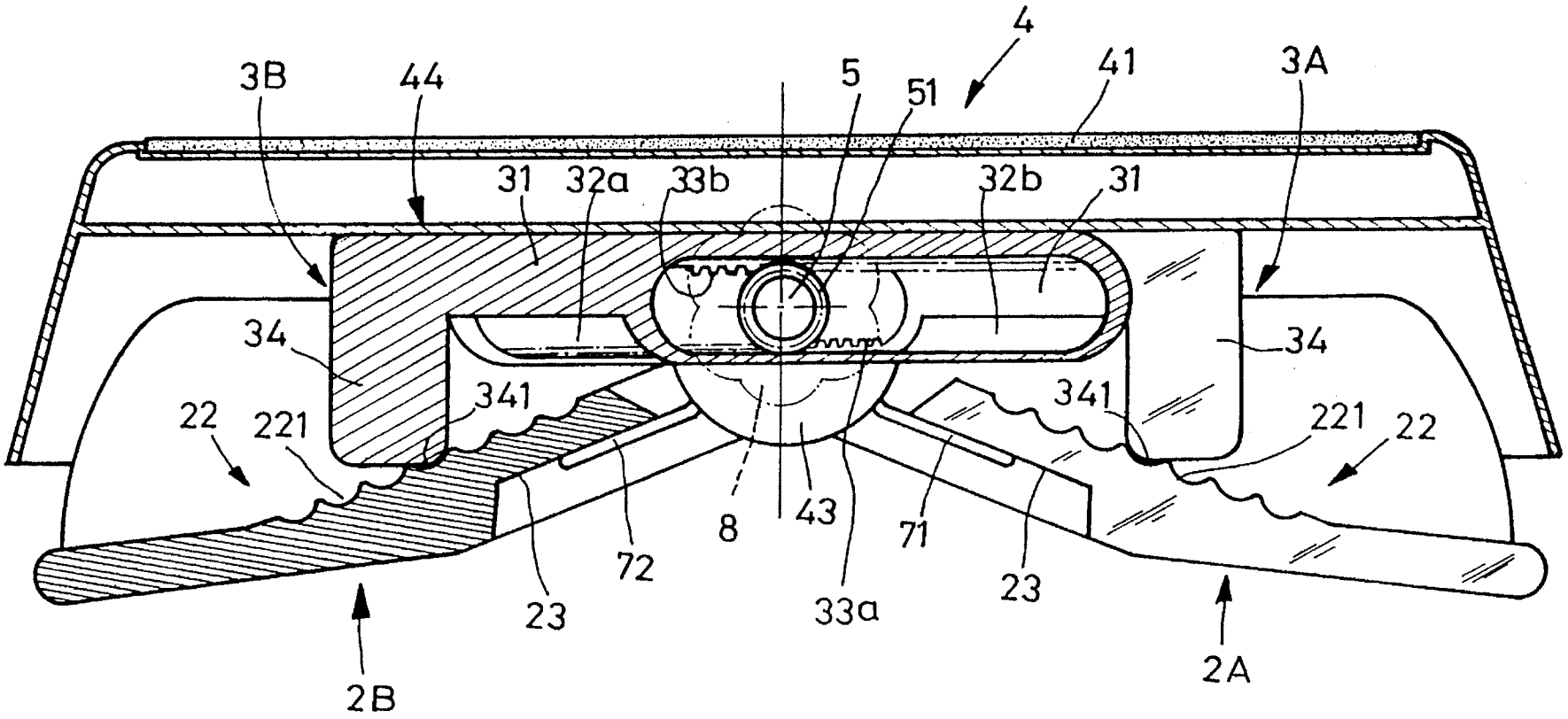
FIG. 10 is similar to FIG. 9 but showing the top block adjusted to the medium-height position.

FIG. 9 shows the stand 4 arranged at the lowest elevation in which the stop members 3A and 3B are bilaterally extended outwards, the transverse stop rods 34 of the stop members 3A and 3B are respectively disconnected from the upstanding sloping walls 22 and supported on the base blocks 2A and 2B. When the adjustment knob 8 is turned clockwise, the first stop member 3A is moved leftward and the second stop member 3B is moved right ward, i.e., the stop members 3A and 3B are moved toward each other. When the stop members 3A and 3B are moved toward each other, as shown in FIG. 10, the transverse stop rods 34 of the stop members 3A and 3B are respectively moved upward along the respective upstanding sloping walls 22, and therefore the elevation of the top block 4 is lifted. On the contrary, when the adjustment knob 8 is turned counter-clockwise, the transverse stop rods 34 of the stop members 3A and 3B are respectively moved downward along the respective upstanding sloping walls 22, and therefore the elevation of the stop block 4 is lowered. As indicated, the upstanding sloping walls 22 have respective transverse grooves 221 for engagement with the chamfered bottom side 341*s* of the transverse stop rods 34 of the stop members 3A and 3B, therefore the top block 4 can be stopped at the desired elevation within the moving range of the stop members 3A and 3B; the base blocks 2A and 2B are respectively turned about the end caps 6A and 6B and stretched by the torsional springs 7A and 7B, the torsional springs 7A and 7B stop the base blocks 2A and 2B from being collapsed together.

APPLICATION EXAMPLE I

Figure 11:
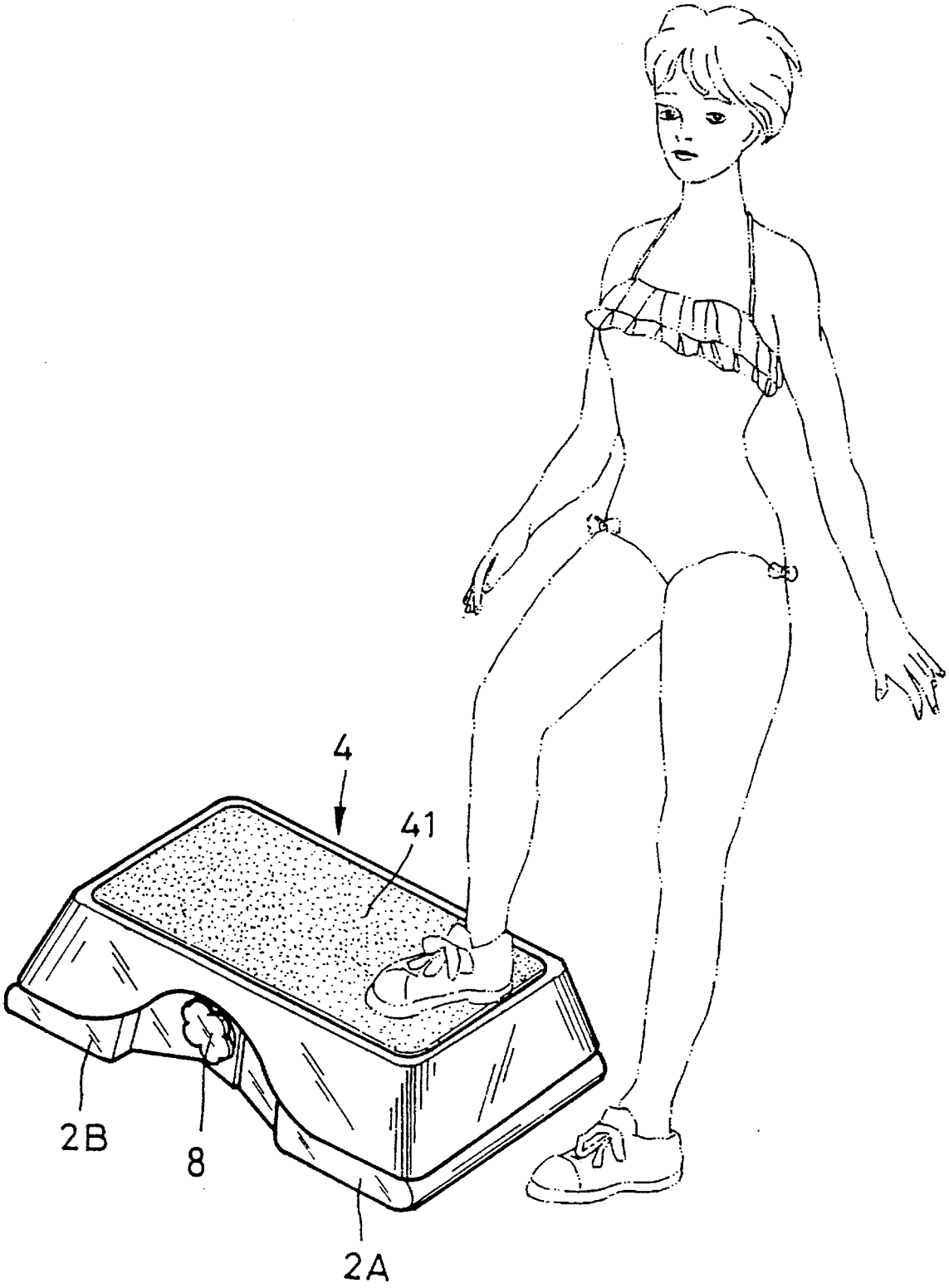
FIG. 11 is an applied view of the present invention, showing the elevation-adjustable stand used as a stand for aerobatic exercises.

FIG. 11 shows the stand placed on a flat surface and used for an aerobatic exercise. When to adjust the elevation of the top block 4, the player needs not to lift the top block 4 with both hands, and the adjustment can be easily done by one hand by turning the adjustment knob 8 in one direction.

APPLICATION EXAMPLE II

Figure 12:
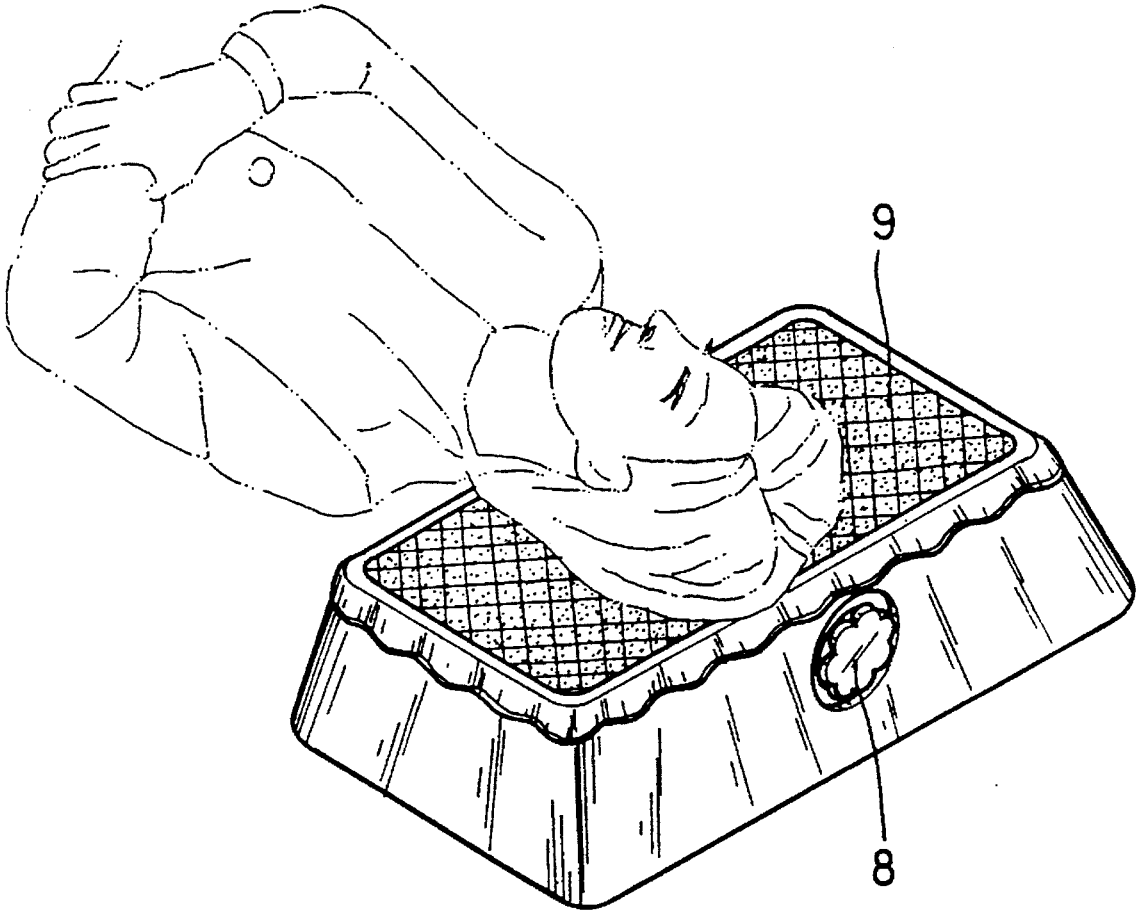
FIG. 12 is another applied view of the present invention, showing the elevation-adjustable stand used as a pillow.

FIG. 12 shows the stand used as a pillow for putting under the head. When the stand is used as a pillow, a pillow slip 9 may be used and covered on the stand.

While only one embodiment of the present invention has been shown and described, it will be understood that various modifications and changes could be made without departing from the spirit and scope of the invention disclosed.

I claim:

1. A stand comprising:

two symmetrical base blocks, each comprising two forward eyed lugs bilaterally disposed at one end, each eyed lug defining a respective pivot hole, an upstanding sloping wall in the middle, and a series of transverse grooves on said upstanding sloping wall at different elevations;

a first stop member and a second stop member symmetrically mounted above said base blocks, each stop member comprising a longitudinal coupling rod, which defines a longitudinal opening, and a transverse stop rod perpendicularly connected to one end of said longitudinal coupling rod, said first stop member further comprising a top rack longitudinally disposed inside the respective longitudinal opening, said second stop member further comprising a bottom rack longitudinally disposed inside the respective longitudinal opening, the transverse stop rod of each stop member having a chamfered bottom side for engagement with the transverse grooves of the upstanding sloping wall of one base block;

a top block supported on said stop members above said base blocks, said top block comprising a top side covered with a soft mat, two curved side walls at two opposite lateral sides, two opposite pairs of downward eyed lugs bilaterally disposed in the middle and defining a respective pivot hole, and a bottom chamber defined between the two opposite pairs of downward eyed lugs to hold said stop members;

a shaft revolvably mounted on the downward eyed lugs of said top block to hold said stop members inside said bottom chamber, said shaft comprising a toothed shaft body inserted through the longitudinal openings of said stop members and meshed with said top rack and said bottom rack, two round rods respectively extended from two opposite ends of said toothed shaft body and inserted into the respective pivot holes on the downward eyed lugs of said top block, a rectangular coupling hole on one round rod, and a longitudinal slot on said toothed shaft body in communication with said rectangular coupling hole;

two end caps respectively inserted through the pivot holes of the eyed lugs of said base blocks and then sleeved onto the round rods of said shaft, each end cap comprising a barrel inserted into the respective pivot holes on the eyed lugs of said base blocks at one side and sleeved onto one round rod of said shaft, an outward flange raised around one end of said barrel and stopped outside said base blocks, and a springy hook raised from said barrel and hooked on one eyed lug of said top block;

two torsional springs respectively mounted around the barrels of said end caps, each having two opposite ends respectively stopped between said base blocks; and an adjustment knob for turning said shaft to move said stop members in reversed directions in lifting said top block, said adjustment knob comprising a round shank inserted into the barrel of one end cap, a square extension rod longitudinally extended from one end of said round shank and fitted into the rectangular coupling hole of said shaft, a springy hook raised from said square extension rod and hooked into the longitudinal slot of the toothed shaft body of said shaft, and a hand wheel at an opposite end of said round shaft for turning by hand.

* * * * *